US012565688B2

(12) United States Patent
Ikuta et al.

(10) Patent No.: US 12,565,688 B2
(45) Date of Patent: Mar. 3, 2026

(54) METHOD FOR OPERATION OF BLAST FURNACE

(71) Applicant: Kobe Steel, Ltd., Kobe (JP)

(72) Inventors: Shoji Ikuta, Kakogawa (JP); Akito Kasai, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 1009 days.

(21) Appl. No.: 17/598,044

(22) PCT Filed: Mar. 26, 2020

(86) PCT No.: PCT/JP2020/013733
§ 371 (c)(1),
(2) Date: Sep. 24, 2021

(87) PCT Pub. No.: WO2020/196769
PCT Pub. Date: Oct. 1, 2020

(65) Prior Publication Data

US 2022/0177985 A1 Jun. 9, 2022

(30) Foreign Application Priority Data

Mar. 28, 2019 (JP) ..... 2019-063381

(51) Int. Cl.
*C21B 7/16* (2006.01)
*C21B 5/00* (2006.01)

(52) U.S. Cl.
CPC ..... *C21B 7/16* (2013.01); *C21B 5/003* (2013.01); *C21B 5/008* (2013.01)

(58) Field of Classification Search
CPC ..... C21B 7/16; C21B 5/003; C21B 5/008; C21B 5/023; C21B 5/06
USPC ..... 266/265
See application file for complete search history.

(56) References Cited

U.S. PATENT DOCUMENTS 9,873,923 B2 * 1/2018 Murao ..... F27D 3/16
2010/0037729 A1 * 2/2010 Gaur ..... C04B 35/6267 75/460
2015/0240322 A1 8/2015 Sakaguchi et al.

FOREIGN PATENT DOCUMENTS

CN 101307370 * 10/2010 ..... Y02P 10/20
EP 2 871 247 A1 5/2015
EP 2 987 871 B1 2/2019
JP 4-2708 A 1/1992
(Continued)

OTHER PUBLICATIONS

JP2012153947, Method for producing Agglomerate for raw material for blast furnace, Kasai et al. Aug. 16, 2012 (Year: 2012).*
(Continued)

*Primary Examiner* — Jessee R Roe
*Assistant Examiner* — Michael Aboagye
(74) *Attorney, Agent, or Firm* — Oblon, McClelland, Maier & Neustadt, L.L.P.

(57) ABSTRACT

A method for a blast furnace includes pulverizing coal to make pulverized coal, and pulverizing iron ore to make pulverized iron ore, and injecting the pulverized coal and the pulverized iron ore from a tuyere. A loss on ignition of the iron ore is greater than or equal to 9% by mass and less than or equal to 12% by mass, an injection rate of the pulverized coal is greater than or equal to 150 kg/tp, and an injection rate of the pulverized iron ore is greater than or equal to 2.5 kg/tp and less than or equal to 50.0 kg/tp.

2 Claims, 15 Drawing Sheets

(56) References Cited

FOREIGN PATENT DOCUMENTS

| | | | | | |
|---|---|---|---|---|---|
| JP | H0551612 | * | 3/1993 | ..... | C21B 5/00 |
| JP | H05239516 | * | 9/1993 | ..... | C21B 5/00 |
| JP | 9-157712 | A | 6/1997 | | |
| JP | 9-165607 | A | 6/1997 | | |
| JP | 9-194913 | A | 7/1997 | | |
| JP | 9-324205 | A | 12/1997 | | |
| JP | 2012153947 | * | 8/2012 | ..... | C21B 5/00 |

OTHER PUBLICATIONS

JPH0551612, Method of blowing Powder Into Blast Furnace Through its Tuyere, Suyama, Mar. 2, 1993 (Year: 1993).*
JPH05239516, Horisaka et al., Operation of injection of powder from Tuyere in blast furnace, Sep. 17, 1993 (Year: 1993).*
CN101307370, Xiao, Method for Blowing Powder Into Blast Furnace Through Its Tuyere, Oct. 13, 2010 (Year: 2010).*
Extended European Search Report issued Mar. 11, 2022 in European Patent Application No. 20778098.2, 9 pages.
Xingguo et al., "Mathematical Model of Blast Furnace Raceway Zone with Pulverized Coal and Fine Ore Injection", Iron and Steel, vol. 78, 1992, p. 1230 (with partial translation).
Sugiyama et al., "Analysis on Liquid Flow in the Dripping Zone of Blast Furnace", Iron and Steel, vol. 73, 1987, p. 2044 (with partial translation).
Kato et al., Evaluation of bird nest gas permeability by slag drop experiment (Improvement of gas permeability at lower part of blast furnace by LD-slag injection-1), Materials and Processes, CAMP-ISIJ, vol. 28, 2015, p. 25 (with partial translation).
Fukutake et al., Iron and Steel, vol. 66, No. 13, 1980, p. 1974 (with partial translation).
Hayashi et al., Iron and Steel, vol. 48, No. 12, 1962, p. 1606 (with partial translation).
Sumita et al., Journal of the Japan Institute of Metals and Materials, vol. 44, No. 1, 1980, p. 95 (with partial translation).

* cited by examiner

METHOD FOR OPERATION OF BLAST FURNACE

TECHNICAL FIELD

The present invention relates to a method for operation of a blast furnace.

BACKGROUND ART

Conventionally, in a blast furnace, molten iron is produced by: alternately charging coke and iron ore raw materials (iron ore, sintered iron ore, pellets, and the like) in layers from a furnace top; and injecting pulverized coal together with hot air (air, oxygen) from a tuyere, to reduce and melt the iron ore raw materials. To conduct stable operations in such a blast furnace having a solid/gas countercurrent transfer layer, it is important to maintain favorable gas permeability inside the furnace because lowering the gas permeability hinders stable operations.

For example, coke has a role as a spacer which secures gas permeability inside the furnace; thus, a certain amount of coke must be used. However, if the use of coke can be reduced and the gas permeability inside the furnace can be lowered, expensive coke can be substituted with inexpensive pulverized coal, whereby a coke usage amount (coke rate) can be decreased.

In recent years, it has become common to conduct blast furnace operations in which pulverized coal is injected from a tuyere of the blast furnace, the pulverized coal being used as a fuel to replace a part of the coke (reducing agent). Recently, high pulverized coal injection operations, in which a usage amount of pulverized coal is as high as 150 kg/tp or more, have come to be stably carried out.

Herein, the pulverized coal to be injected into the blast furnace contains ash in a content of about 10% by mass (hereinafter, simply denoted as "%"), the ash consisting of 50% to 60% $SiO_2$, 20% to 30% $Al_2O_3$, and also $Fe_2O_3$, CaO, and the like, being mainly constituted from acidic components.

Thus, when the injection rate of the pulverized coal rises, acidic slag derived from the ash in the pulverized coal increases, thereby increasing viscosity and/or a melting point of a slag layer (commonly referred to as "bird's nest slag") which accumulates in a bird's nest region in an interior of a raceway. Accordingly, an accumulation amount of the bird's nest slag (hold-up) increases, whereby gas permeability in a lower portion of the blast furnace lowers (see FIG. 15).

With respect to the above-mentioned lowering of gas permeability in the lower portion of the blast furnace, Patent Document 1 discloses a technique in which productivity of the blast furnace is increased and the coke rate is decreased by using iron ore having a combined-water content of greater than or equal to 2.0% by weight as a raw material for a blast furnace smelting method. Specifically, the technique according to Patent Document 1 includes: reducing the iron ore having a combined-water content of greater than or equal to 2.0% by weight to have a reduction percentage of greater than or equal to 30%, followed by charging and/or injecting the iron ore, as a raw material for the blast furnace smelting method, into the blast furnace. The reduction of the iron ore is conducted in a reducing atmosphere containing CO and/or $H_2$ at a high temperature of greater than or equal to 400° C.

Furthermore, Patent Document 2 discloses a technique relating to a method for operation of a blast furnace, the technique particularly relating to inhibiting a rise in Si in molten iron that has been tapped. Specifically, the technique of Patent Document 2 involves: simultaneously injecting pulverized ore and pulverized coal from each tuyere, and making a rate of the pulverized ore and the pulverized coal upon injection equivalent to a rate of ore and coke charged from an upper portion of the blast furnace. In the technique of Patent Document 2, it is held that due to injecting the pulverized ore in addition to the pulverized coal, a rise in Si is inhibited, and furthermore, due to making the rate of the pulverized ore and the pulverized coal upon injection equivalent to the rate of ore and coke charged from the upper portion of the blast furnace, a distribution of charged matter in the furnace does not change, thereby making it easy to control the distribution of the charged matter. Moreover, it is reported that due to injecting by division into separate tuyeres, the amount injected from each tuyere is low, and an effect of making equipment trouble unlikely to occur can be achieved.

PRIOR ART DOCUMENTS

Patent Documents

Patent Document 1: Japanese Unexamined Patent Application, Application No. H09-165607

Patent Document 2: Japanese Unexamined Patent Application, Application No. H04-002708

SUMMARY OF THE INVENTION

Problems to be Solved by the Invention

In the method according to Patent Document 1, the injection rate of the non-dehydrated iron ore is as high as 100 kg/tp, and there is significant temperature loss; thus, the accumulation amount of the bird's nest slag (hold-up) cannot be reduced.

Furthermore, with regard to the method disclosed in Patent Document 2, the injection rate of the pulverized coal is as low as 0 to 40 kg/tp, whereby the accumulation amount of the bird's nest slag (hold-up) cannot be reduced. Moreover, characteristic features of the ore are not disclosed in Patent Document 2; thus, at the time of injection, there is a possibility that the molten iron temperature in the blast furnace will decrease due to insufficient reduction of the ore, whereby a further increase in the coke rate will be necessitated. In addition, the technique of Cited Publication 2 is a technique relating to reducing Si in molten iron; thus, unlike the present invention, Patent Document 2 does not have an object of improving gas permeability in a lower portion of the blast furnace.

The present invention was made in view of the foregoing problems, and an object of the present invention is to provide a method for operation of a blast furnace that enables gas permeability in a lower portion of a blast furnace by injection of pulverized iron ore from a tuyere to be improved.

Means for Solving the Problems

In order to solve the aforementioned problems, the method for operation of a blast furnace of the present invention involves the following technical measures.

Specifically, the method for operation of a blast furnace of the present invention includes: pulverizing coal to make pulverized coal, and pulverizing iron ore to make pulverized iron ore; and injecting the pulverized coal and the pulverized iron ore from a tuyere, characterized in that a loss on ignition of the iron ore is greater than or equal to 9% by mass and less than or equal to 12% by mass, an injection rate of the pulverized coal is greater than or equal to 150 kg/tp, and an injection rate of the pulverized iron ore is greater than or equal to 2.5 kg/tp and less than or equal to 50.0 kg/tp.

It is to be noted that the iron ore and the coal are preferably pulverized together.

Effects of the Invention

According to the method for operation of a blast furnace of the present invention, improvement of gas permeability in a lower portion of a blast furnace by injecting the pulverized iron ore from a tuyere is enabled.

DESCRIPTION OF EMBODIMENTS

Hereinafter, embodiments of a method for operation of a blast furnace 1 according to the present invention are described in detail based on the drawings.

Figure 1:
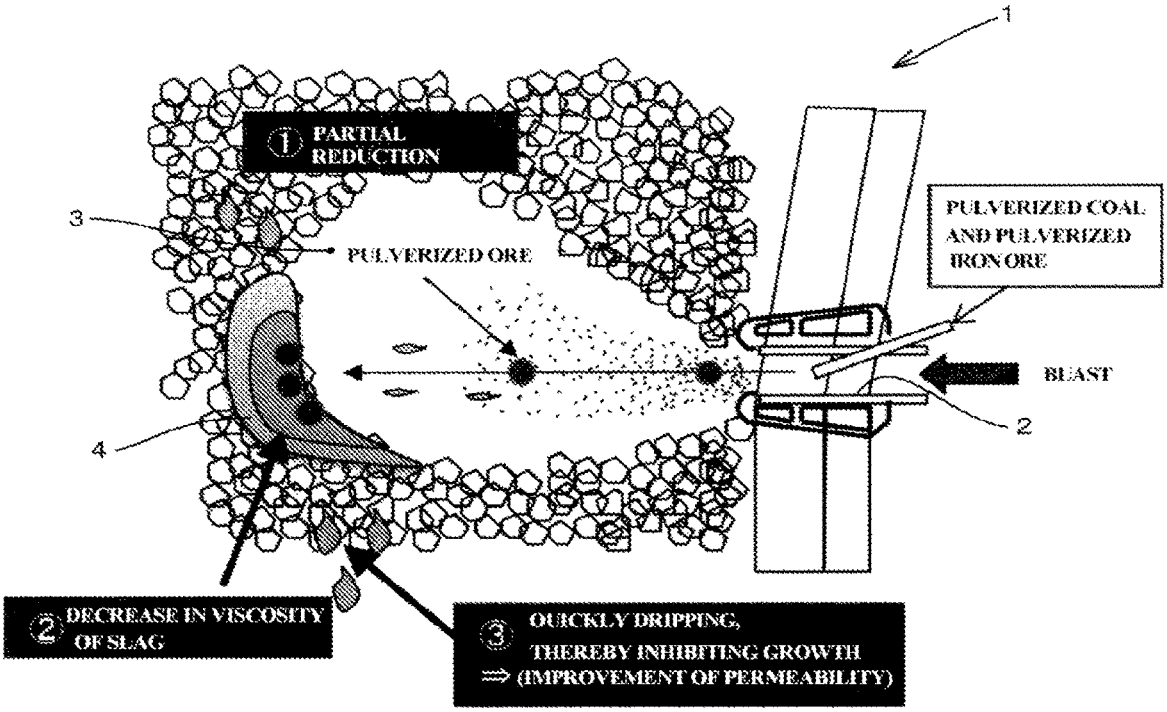
FIG. 1 is a drawing schematically illustrating treatment conducted by a tuyere in the method for operation of a blast furnace of the present invention.

As shown in FIG. 1, the method for operation of the blast furnace 1 includes: pulverizing coal to make pulverized coal, and pulverizing iron ore to make pulverized iron ore; and injecting the pulverized coal and the pulverized iron ore from a tuyere 2, characterized in that a loss on ignition of the iron ore is greater than or equal to 9% by mass and less than or equal to 12% by mass, an injection rate of the pulverized coal is greater than or equal to 150 kg/tp, and an injection rate of the pulverized iron ore is greater than or equal to 2.5 kg/tp and less than or equal to 50.0 kg/tp ("kg/tp" as referred to above means a mass (kg) per ton of molten iron; the same applies hereafter).

Specifically, with regard to the blast furnace 1 for which the method for operation of the present invention is conducted, coke and iron ore raw material (iron ore, sintered iron ore, pellets, and the like) are alternately charged in layers from a furnace top, pulverized coal is injected together with hot air (air, oxygen) from the tuyere 2, and molten iron is produced by reducing and melting the iron ore raw material. To conduct stable operations using the blast furnace 1, having a solid/gas countercurrent transfer layer, it is important to favorably maintain gas permeability inside the furnace because lowering of gas permeability hinders stable operations. Coke has a role of a spacer, which secures gas permeability inside the furnace; however, if gas permeability inside the furnace can be made favorable, expensive coke can be substituted with inexpensive pulverized coal, whereby a coke usage amount (coke rate) can be reduced.

In the method for operation of the present invention, as described above, the pulverized coal, being the coal which has been pulverized, and the pulverized iron ore, being the iron ore which has been pulverized, are injected from the tuyere 2.

For example, the pulverized coal has a maximum grain size of less than or equal to 1,000 μm and an average grain size of 50 μm, and is injected into the blast furnace 1 at a rate of greater than or equal to 150 kg/tp. In other words, the method for operation of the present invention is directed toward operations with a high pulverized coal rate, and is a technique which has an object of improving gas permeability inside a furnace in operations with a high pulverized coal rate, and decreasing the coke rate in operations of the blast furnace 1 (the mass (kg) of coke needed in producing 1 ton of molten iron).

Furthermore, the pulverized coal contains ash in a content of about 10% by mass (hereinafter, simply denoted as "%"), the ash consisting of 50% to 60% $SiO_2$, 20% to 30% $Al_2O_3$, and also $Fe_2O_3$, CaO, and the like, being mainly constituted from acidic components.

Thus, when the injection rate of the pulverized coal becomes high, acidic slag derived from the pulverized coal increases, thereby increasing viscosity and/or a melting point of a slag layer (commonly referred to as "bird's nest slag 4") which accumulates in an interior of a raceway (being a bird's nest region 3), as shown in FIG. 1, whereby gas permeability lowers (the pressure loss increases). As a result, gas permeability in a lower portion of the blast furnace 1 lowers.

Figure 2:
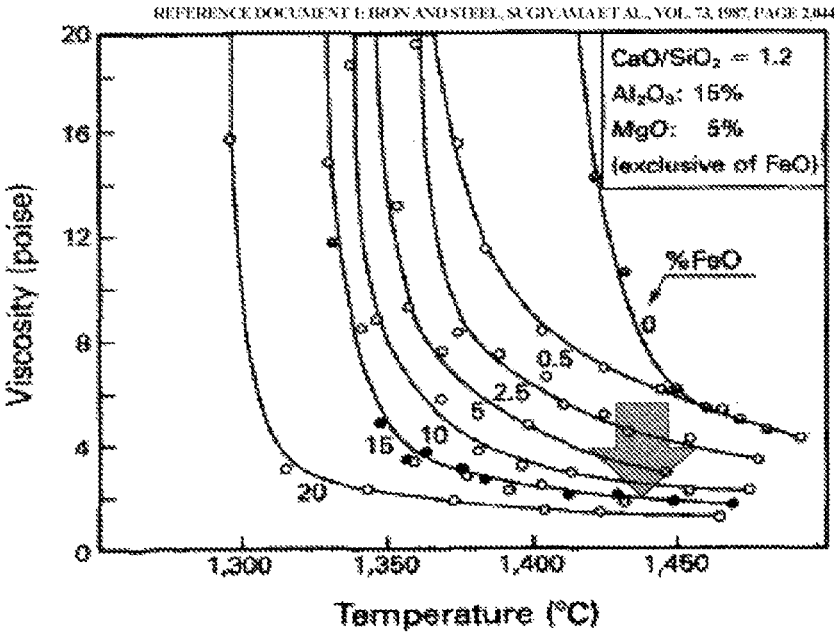
FIG. 2 is a graph showing the manner in which viscosity characteristics of slag containing 15% $Al_2O_3$ and 5% MgO, and having a basicity of 1.2 change in accordance with a percentage content of FeO.
Figure 3:
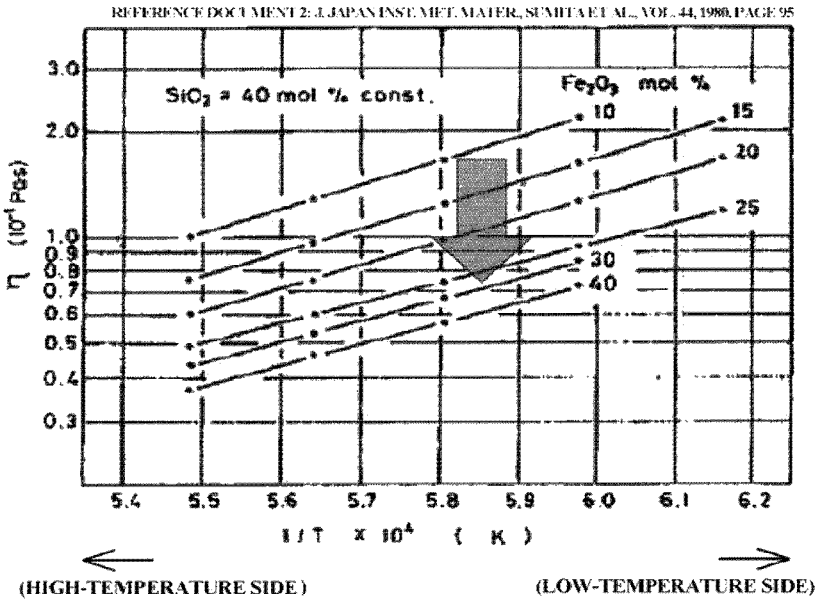
FIG. 3 is a graph showing the manner in which viscosity characteristics of slag containing 40 mol % $SiO_2$ change in accordance with a concentration by mol % of $Fe_2O_3$.

Incidentally, the method for operation of the present invention involves injecting iron ore from the tuyere 2 in addition to the pulverized coal. There is already knowledge of such iron ore injection in Japanese Unexamined Patent Application, Application No. 05-214414 and the like. For example, as shown in FIG. 2 and the like, when injecting iron ore ($Fe_2O_3$) from a tuyere, it is reported that, e.g., at a time of reaching the bird's nest region, 10% to 40% is accounted for by $Fe_3O_4$ to FeO, while a part of the iron ore is reduced as metal iron, and that when the iron ore and the coal are pulverized simultaneously, the coal and the iron ore are positioned in proximity to each other and a reduction percentage improves. Furthermore, FIGS. 2 and 3 show that typically, viscosity decreases when iron oxide component(s) (FeO, $Fe_2O_3$) is/are added to acidic slag.

In other words, as is seen from the aforementioned FIG. 2 and the like, when the coal and the iron ore are injected together from the tuyere, a portion of the iron ore is reduced in the raceway, whereby reduced and pulverized iron ore is trapped in the bird's nest slag in the interior of the raceway. As a result, the viscosity of the slag decreases due to the iron oxide component(s) of the reduced and pulverized iron ore, and the bird's nest slag becomes prone to dripping. Accordingly, it is considered that an effect can be obtained in which an amount of slag which accumulates in the bird's nest decreases, leading to a decrease in slag hold-up, whereby gas permeability in a lower portion of the furnace improves (pressure loss of the lower portion of the furnace decreases).

However, in a case in which iron oxide contained in the pulverized iron ore reacts with coke in the furnace, it will result in a direct reducing reaction (for example, FeO+C Fe+CO). Due to this reaction being accompanied by significant heat absorption, there is a possibility of a molten iron temperature being decreased, thereby becoming a cause of cooling of the molten iron. In other words, the pulverized iron ore cannot be immoderately injected with simply the intention of making the gas permeability favorable.

Thus, in the method for operation of the blast furnace 1 of the present invention, iron ore characteristics and the injection rate are regulated to appropriate conditions so as to enable achieving both improvement in gas permeability and prevention of cooling.

Next, iron ore characteristics of the iron ore, being a raw material for pulverized iron ore in the method for operation of the present invention, and the injection rate of the pulverized iron ore are described.

The pulverized iron ore is obtained by pulverizing the iron ore. The iron ore, being the raw material for the pulverized iron ore, has a loss on ignition of greater than or equal to 9% by mass and less than or equal to 12% by mass. Loss on ignition (LOI) in the iron ore is an index measured in accordance with JIS M8850; in the case of the iron ore, LOI indicates mainly a content of combined water.

Thus regulating the loss on ignition (LOI) of the iron ore has the purpose of making a pulverizing property of the pulverized iron ore equivalent to that of the coal for the pulverized coal, thereby making the iron ore easily pulverizable (easily made fine), whereby the grain size of each of the iron ore and the coal in the case of being pulverized is matched. The HGI (Hardgrove Index) is an index expressing the pulverizing property, indicated by a coal HGI strength test (JIS M8801). The pulverizing properties of multiple types of iron ore are measured in accordance with a coal HGI strength test procedure; determining a relationship between the pulverizing property and the loss on ignition (LOI) results in a relationship such as that shown in FIG. 4.

Figure 4:
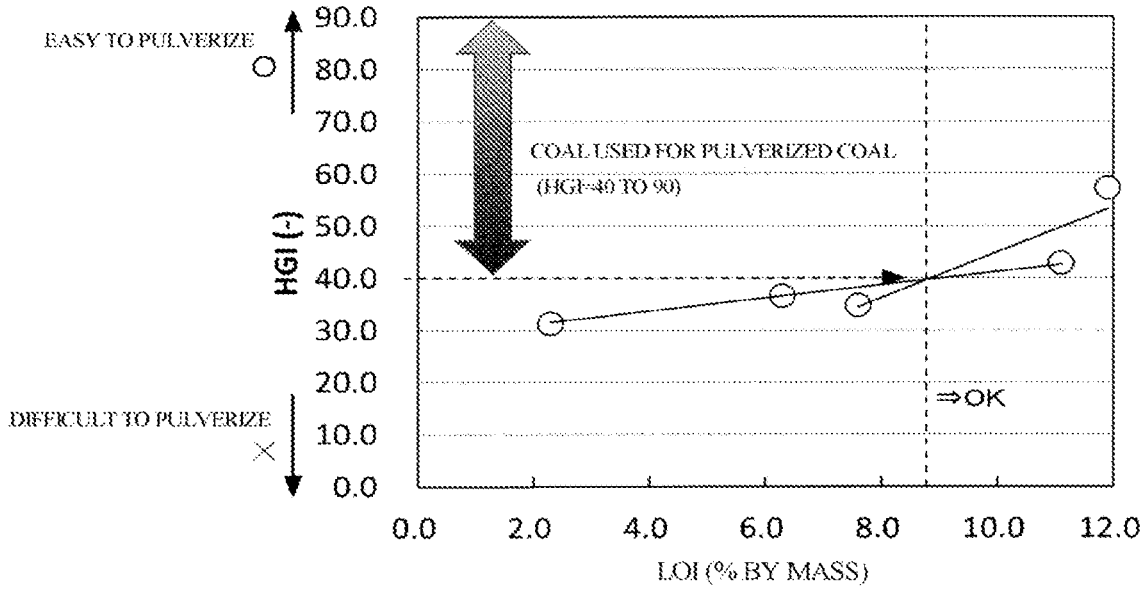
FIG. 4 is a graph showing a relationship between a loss on ignition of coal used for pulverized coal, and a Hardgrove Index.

As shown in FIG. 4, when the loss on ignition (LOI) of the iron ore is high, the HGI of the iron ore also becomes high, whereby the iron ore is more easily pulverized (more easily made fine).

Herein, the HGI of the coal used as the pulverized coal for the burst furnace 1 is typically 40 to 90. The HGI of the coal is set to greater than or equal to 40 because when the HGI falls below 40, the pulverizing property deteriorates and the grain size increases, whereby equipment wear and the like may occur. Furthermore, the HGI of the coal is set to less than or equal to 90 because when the HGI exceeds 90, coal being pulverized too finely may be a cause of pipe occlusion.

In the case in which the loss on ignition is greater than or equal to 9% by mass and less than or equal to 12% by mass, the HGI of the iron ore becomes 40 to 90, similar to that of the coal for the pulverized coal, and the grain size of the pulverized iron ore when the iron ore has been pulverized becomes similar to that of the pulverized coal (maximum grain size of less than or equal to 1,000 μm, average grain size of 50 μm), thereby enabling preventing equipment wear and rupturing of transportation pipes.

Figure 5:
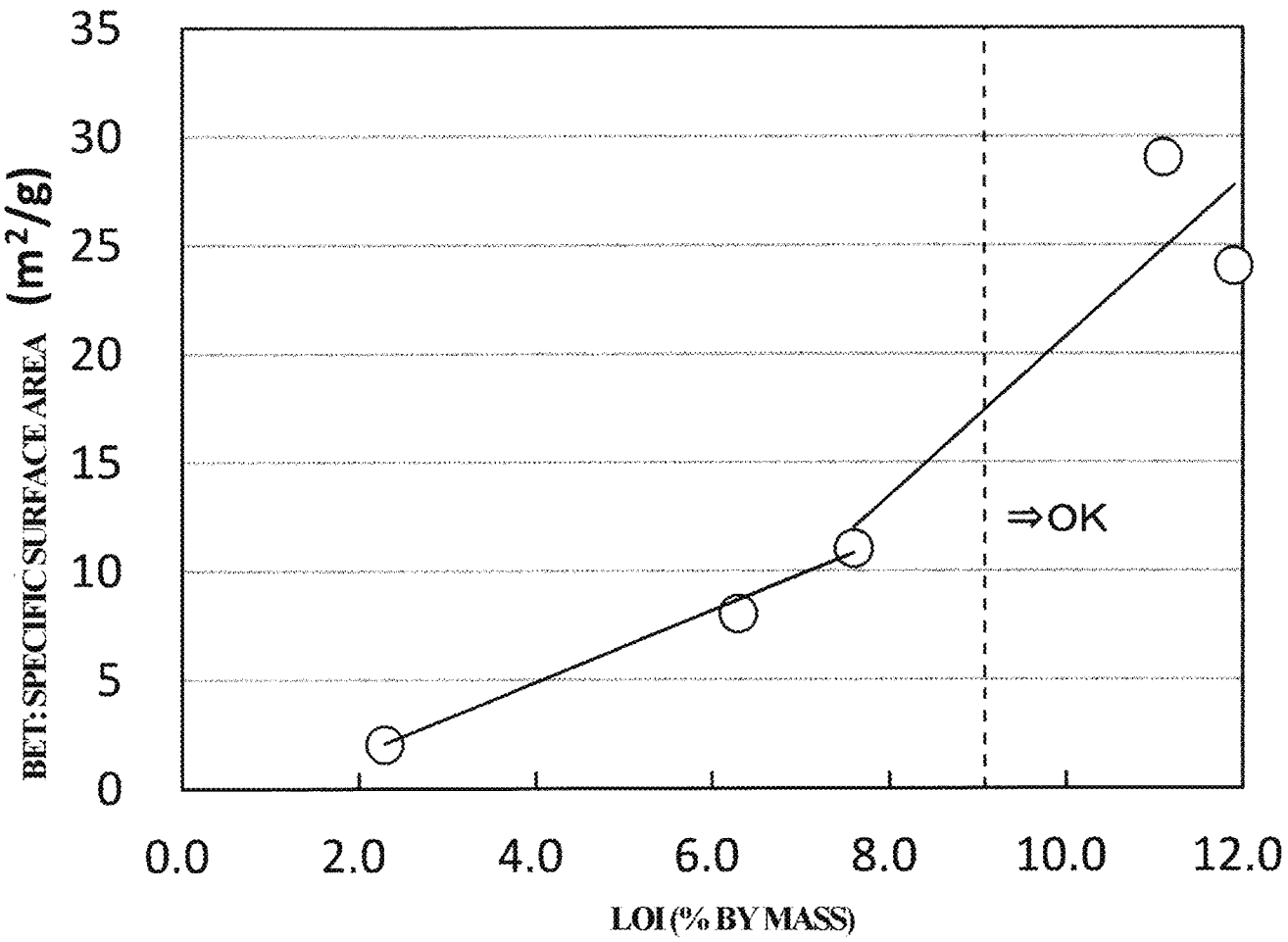
FIG. 5 is a graph showing a relationship between a specific surface area and the loss on ignition of the coal used for the pulverized coal.

Furthermore, as shown in FIG. 5, the loss on ignition (LOI) of the iron ore and a specific surface area (BET) are positively correlated: when the loss on ignition increases, the specific surface area also increases. The pulverized iron ore (iron ore) having a high specific surface area more readily reacts in the raceway, thereby also enabling an improvement in the reduction percentage of the pulverized iron ore.

Due to the above, at the time when the pulverized iron ore is trapped in the bird's nest slag 4 in the interior of the raceway, accumulation of the bird's nest slag 4 can be decreased by lowering the viscosity of the bird's nest slag 4. As a result, the pressure loss of the blast furnace 1 is reduced, whereby gas permeability in the lower portion of the blast furnace 1 can be made favorable.

It is to be noted that in the case in which the loss on ignition (LOI) of the iron ore is less than 9% by mass, pulverizing is difficult due to using iron ore having a low HGI as the raw material. As a result, the grain size of the pulverized iron ore increases and significant equipment wear may occur, possibly leading to operation trouble such as the rupturing of the transportation pipes, thereby disabling usage. Moreover, iron ore in which the loss on ignition (LOI) is low has a low specific surface area, whereby the reduction percentage in the raceway decreases during injection from the tuyere 2. Thus, there is increased heat absorption due to a direct reducing reaction with furnace core coke in the interior of the raceway, facilitating a decrease in the molten iron temperature (a decrease in furnace heat). As a result, the pressure loss conversely increases, whereby it may be impossible to obtain the effect due to the injection of the pulverized iron ore.

Furthermore, with regard to a case in which the loss on ignition (LOI) of the iron ore is greater than 12% by mass, iron ore having such a loss on ignition does not exist; thus, the case in which the LOI is greater than 12% by mass is excluded.

Next, the injection rate of the pulverized iron ore is described.

Figure 6:
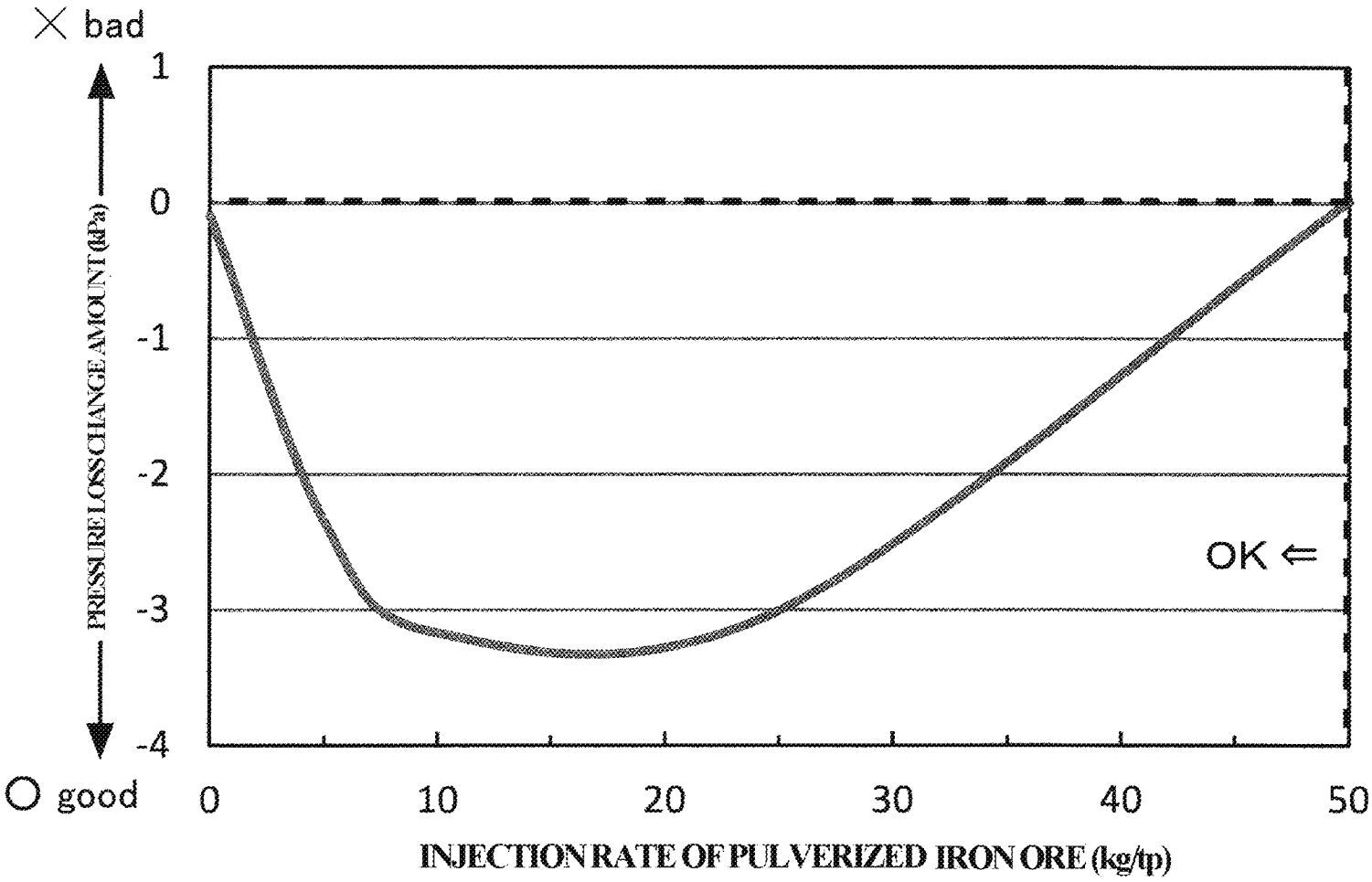
FIG. 6 is a graph showing the relationship between an injection rate of pulverized iron ore and a pressure loss change amount of a blast furnace.

Using the calculation procedure of FIG. 9, described later, the relationship between the injection rate of the pulverized iron ore and a pressure loss reduction amount was calculated. The calculation results are shown in FIG. 6. When the injection rate of the pulverized iron ore is increased, the viscosity of the bird's nest slag 4 decreases, and a linear velocity of dripping increases, whereby the slag hold-up is reduced (the slag accumulation amount decreases). As a result, the pressure loss reduction amount increases. However, when the injection rate of the pulverized iron ore becomes greater than or equal to 20 kg/tp, the slag amount in the bird's nest region increases, whereby the pressure loss reduction amount decreases due to an influence of a decrease in slag temperature. It is to be noted that when the injection rate of the pulverized iron ore increases to greater than 50 kg/tp, the pressure loss will rise beyond the condition in which the injection rate of the pulverized iron ore is 0 kg/tp (base), whereby the effect will be lost.

Figure 7:
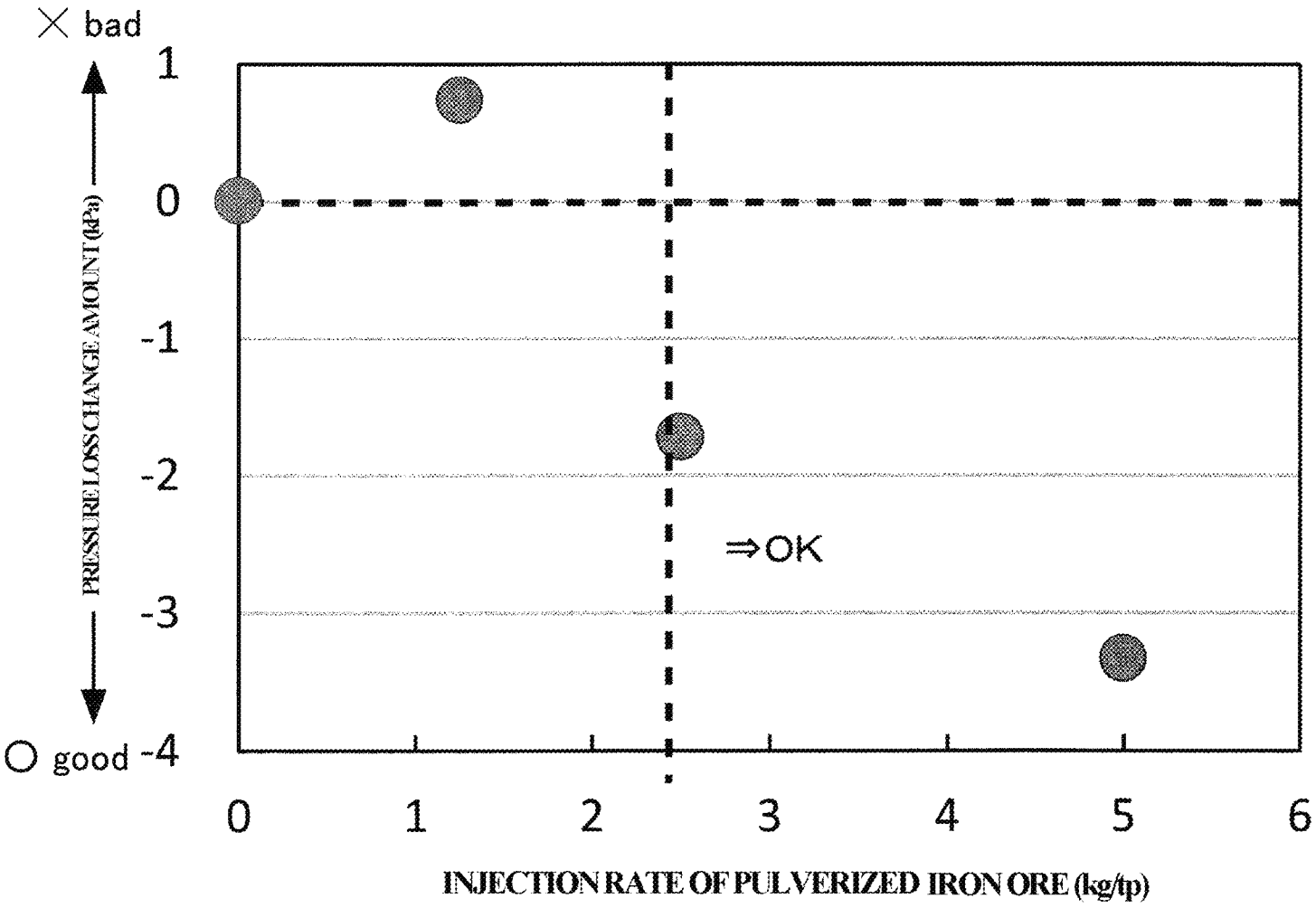
FIG. 7 is a graph showing the result of using an actual blast furnace to investigate a relationship between the injection rate of pulverized iron ore, and a pressure loss change amount of the blast furnace.
Figure 9:
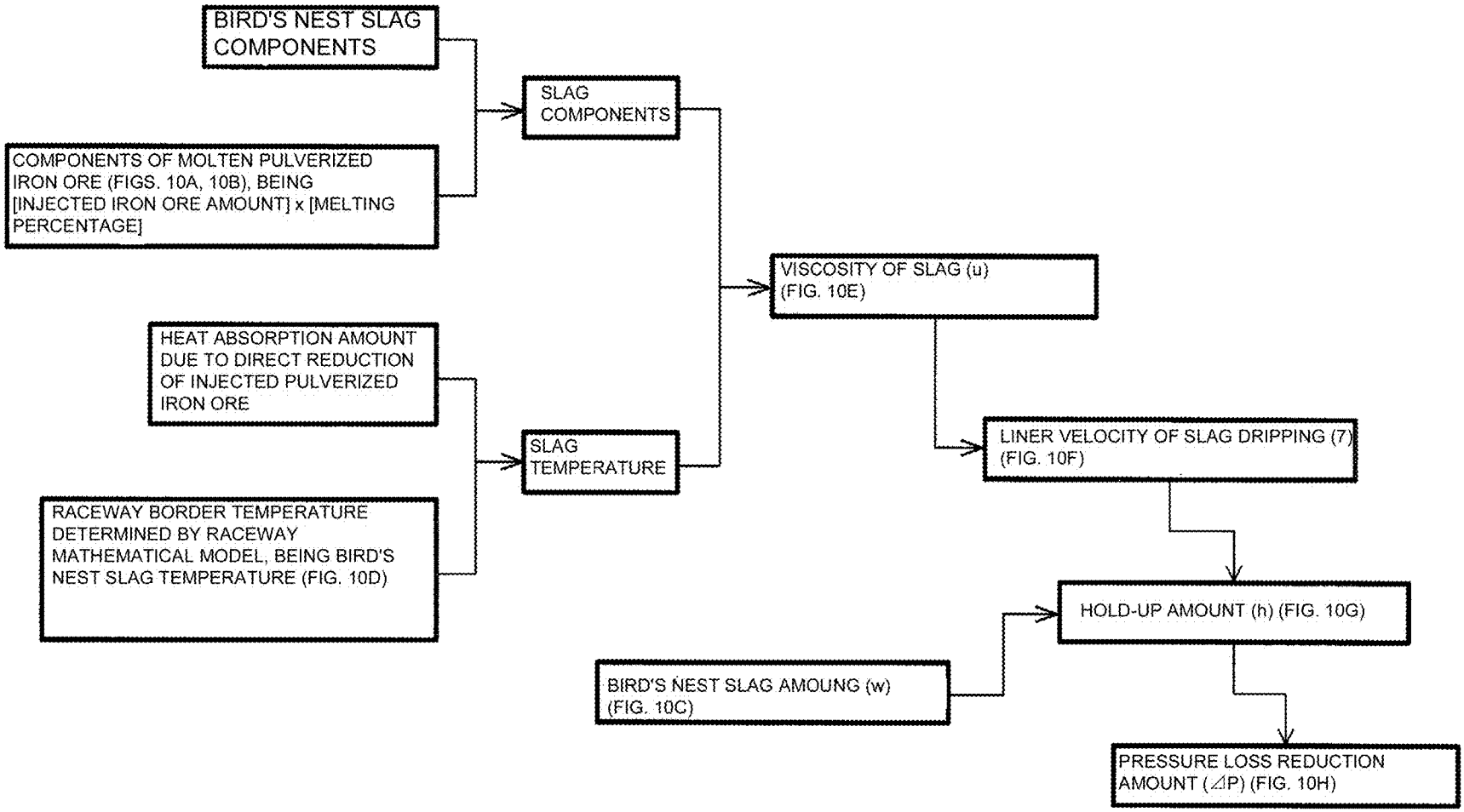
FIG. 9 is a block diagram showing a procedure for calculating the pressure loss change amount of the blast furnace.

It is to be noted that the results in FIG. 6, described above, were calculated in accordance with the calculation procedure disclosed in FIG. 9, but when tests are conducted using an actual blast furnace, results such as those shown in FIG. 7 are obtained.

Figure 8:
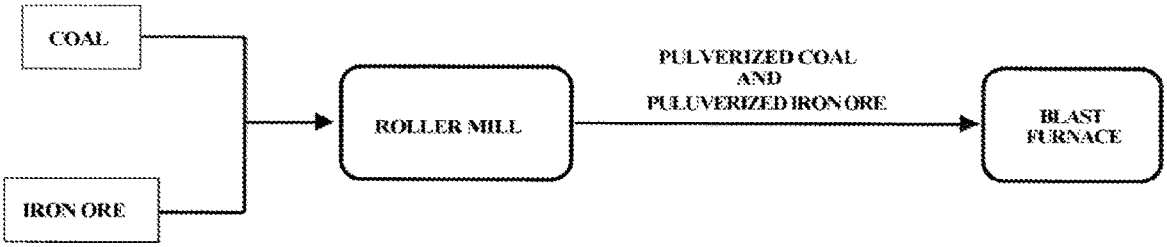
FIG. 8 is a block diagram showing a procedure of the method for operation of the present invention.

As shown in FIG. 7, when operations were conducted in accordance with the procedure disclosed in FIG. 8 using the actual blast furnace, the pressure loss did not decrease when the injection rate of the pulverized iron ore was 1.3 kg/tp, whereas the pressure loss decreased similar to that of FIG. 6 from when the injection rate was 2.5 kg/tp. It is considered that this was due to the injection rate being low when the injection was conducted at 1.3 kg/tp, wherein the pulverized iron ore could not be distributed in equal quantity to the tuyeres 2, being 25 in number in a circumferential direction, leading to circumferential balance becoming disrupted and thus preventing obtaining the effect of improving the gas permeability. Accordingly, in the method for operation of the present invention, the lower limit of the injection rate of the pulverized iron ore in which the effect of the present invention is exhibited was set to greater than or equal to 2.5 kg/tp.

Furthermore, in a case in which the injection rate of the pulverized iron ore is greater than 50 kg/tp, sensible heat of the injection (a heat absorption amount) increases, whereby the temperature of the bird's nest slag (T) decreases. Furthermore, an inflowing slag amount (W) also increases, whereby the pressure loss increases in excess of the base before the injection.

It is to be noted that the pulverized iron ore as described above means iron ore having been subjected to pulverizing treatment by a roller mill, ball mill, or the like, and means iron ore having been pulverized to less than or equal to 1,000 μm. Moreover, the pulverized coal means coal having been subjected to pulverizing treatment by the same roller miller, ball mill, or the like, and means coal having been pulverized to less than or equal to 1,000 μm.

Examples

Hereinafter, the effects of the method for operation of the blast furnace 1 of the present invention are described in detail by way of Comparative Examples and Examples.

First, changes in the pressure loss reduction amount with respect to the injection rate of the pulverized iron ore were determined in accordance with the calculation procedure disclosed in FIG. 9. It is to be noted that the "pressure loss reduction amount" means an extent to which the pressure loss reduced with respect to that before the injection; for example, "the pressure loss reduction amount increased" means the pressure loss reduced, and "the pressure loss reduction amount decreased" means the pressure loss increased. On the other hand, the "pressure loss change amount" means a degree to which the pressure loss increased or decreased with respect to that before the injection. "The pressure loss change amount increased" means the pressure loss increased, whereas "the pressure loss change amount decreased" means, as is written, that the pressure loss decreased.

Furthermore, hereinafter, the results of the method for operation of the present invention are described using symbols defined as shown in Table 1.

TABLE 1

| Item | Unit | Description | Formula(e) |
|---|---|---|---|
| μ | mPa · s | viscosity of bird's nest slag | (1) |
| u | m/s | linear velocity of dripping of bird's nest slag | (1), (2) |
| h | — | hold-up (FIG. 10G) | (2), (3) |
| S | $m^2$ | cross-sectional area of packed bed | (2) |
| W | kg/tp | amount of bird's nest slag (FIG. 10C), being bosh slag + pulverized coal slag + pulverized iron ore | (2) |
| ?P | kPa | pressure loss | (3) |
| L | m | height of bird's nest | (3) |
| k1 | — | coefficient (150) | (3) |
| k2 | — | coefficient (1.75) | (3) |
| ε | — | void fraction | (3) |
| $d_W$ | m | average size of packed bed | (3) |
| V | $Nm^3$/min | gas volume | (3) |
| $\mu_g$ | Pa · s | gas viscosity | (3) |
| $\rho_g$ | $kg/m^3$ | gas density | (3) |

Figure 10:
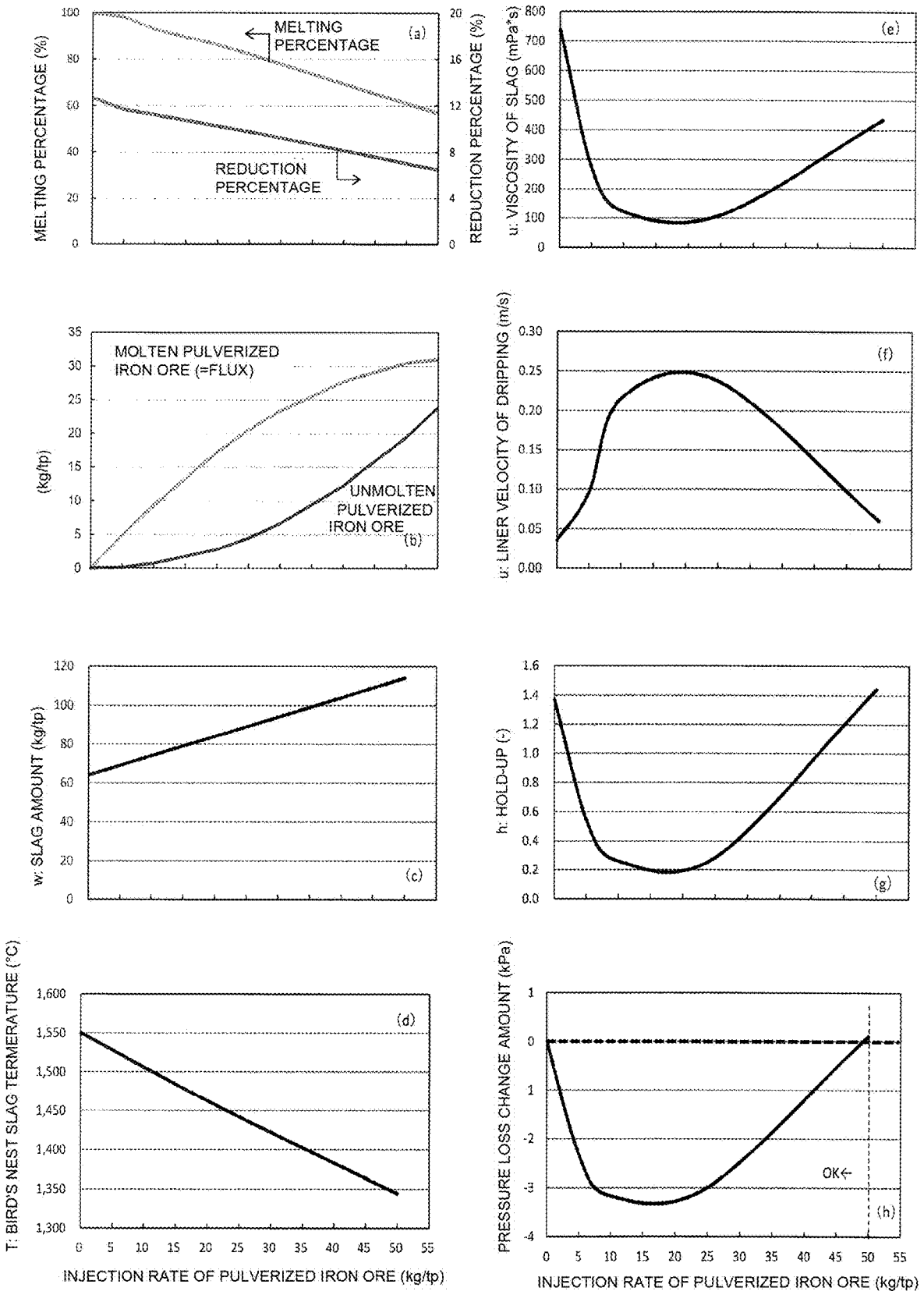
FIGS. 10A to 10H are graphs showing each physical property value obtained in the step of calculating the pressure loss change amount of the blast furnace.

First, the upper limit of the injection rate (upper limit of injection) of the pulverized iron ore from the tuyere 2 will be described. First, changes of the reduction ratio and melting percentage in the raceway, and of a raceway border temperature (temperature of the bird's nest slag 4) are calculated in relation to the injection rate of the pulverized iron ore. This calculation method was carried out based on a mathematical model disclosed in "Iron and Steel, Xiao et al., Vol. 78, 1992, page 1,230." The calculation results are shown in FIG. 10A, and the factors for the calculation are shown in Table 2.

TABLE 2

| Item | Unit | Numeric Value |
|---|---|---|
| blast volume | $Nm^3$/min | 7,600 |
| oxygen volume | $Nm^3$/min | 550 |
| blast temperature | ° C. | 1,180 |
| blast moisture | $g/Nm^3$ | 10 |
| number of tuyeres | number | 40 |
| injection rate of pulverized coal | kg/tp | 215 |
| average size of pulverized coal | μm | 50 |
| injection rate of pulverized iron ore | kg/tp | 0 to 50 |
| average size of pulverized iron ore | μm | 50 |

At this time, based on the premise that only the molten iron ore contributes to the decrease in the viscosity of the bird's nest slag 4, the relationship between the molten iron ore (flux) and the unmelted iron ore was determined from the injection rate and melting percentage of the pulverized iron ore. The thus determined relationship between the molten iron ore and the unmelted iron ore is shown in FIG. 10B.

Furthermore, based on the premise that an entire amount of the injected pulverized iron ore should be added to a slag ratio of the bird's nest slag 4, a relationship between the injection rate of the pulverized iron ore and the amount of the bird's nest slag 4 (*w*) was determined. The thus determined relationship is shown in FIG. 10C. It is to be noted that with regard to components of the bird's nest slag 4, based on a sampling investigation, it was calculated that a ratio of bosh slag components to slag components in the pulverized coal had accumulated in a ratio of 0.18:1.00. Furthermore, with regard to the components and the amount of the bird's nest slag 4 in a state in which the injection rate was 0, calculations were conducted based on the premise that a basicity (C/S) was constant at 0.75, and the amount of bird's nest slag was 64 kg/tp. It is to be noted that the basicity (C/S) is a ratio of CaO (% by mass) to $SiO_2$ (% by mass) contained in the slag.

Moreover, based on the premise that the injected pulverized iron ore directly reduced with an entire amount of the coke, the heat absorption amount (heat absorption portion) of the reduction reaction was subtracted from the raceway border temperature (temperature of the bird's nest 3), and a relationship between the injection rate of the pulverized iron ore and the temperature of the bird's nest slag 4 was determined. The thus determined relationship is shown in FIG. 10D.

Next, the viscosity of the bird's nest slag 4 (μ) was determined. The temperature dependency of the viscosity of the bird's nest slag 4 in each flux rate was determined by way of experiments.

Using the change in the temperature of the bird's nest 3 (the temperature of the bird's nest slag 4) in FIG. 10D, the viscosity (μ) of the bird's nest slag 4 was determined from the experimental values (described in detail below). It is to be noted that the value when the injection rate of the pulverized iron ore was 0 was calculated using a viscosity estimation formula described in "Iron and Steel, Sugiyama et al., Vol. 73, 1987, page 2,044."

The relationship between the injection rate of the pulverized iron ore and the viscosity (μ) of the bird's nest slag 4, determined by the above-described procedure, is shown in FIG. 10E.

Furthermore, with regard to the linear velocity of the dripping of the slag (μ), based on a relational expression described in "Materials and Processes, Kato et al., Vol. 28, 2015, S25," a relationship between the injection rate of the pulverized iron ore and the linear velocity of the dripping was determined. The thus determined relationship is shown in FIG. 10F.

Further, with regard to the hold-up (h), based on a relational expression described in "Materials and Processes, Kato et al., Vol. 28, 2015, S25," a relationship between the injection rate of the pulverized iron ore and the hold-up (h) was determined. The thus determined relationship is shown in FIG. 10G.

At this time, based on the premise that a packed bed cross-sectional area S is 6.67 $m^2$ (constant), the values in FIG. 10C were used for the slag amount (W).

Lastly, a relationship between the injection rate of the pulverized iron ore and the pressure loss reduction amount (pressure loss change amount) was determined. The pressure loss was calculated based on a calculation formula described in "Iron and Steel, Fukutake et al., Vol. 66, 1980, page 1,974." It is to be noted that the calculation factors are as shown in Table 3. The thus determined relationship between the injection rate of the pulverized iron ore and the pressure loss change amount is shown in FIG. 10H.

TABLE 3

| Item | Unit | Value |
|---|---|---|
| pulverized coal injection rate | kg/tp | 215 |
| pulverized iron ore injection rate | kg/tp | 0 to 50 |
| V: bosh gas volume | $Nm^3$/min | 11,340 |
| blast temperature | ° C. | 1,180 |
| blast pressure | kPa | 420 |
| S: cross-sectional area of packed bed | $m^2$ | 6.67 |
| L: bird's nest height | m | 7.5 |

TABLE 3-continued

| Item | Unit | Value |
|---|---|---|
| $\rho_g$: gas density | $kg/m^3$ | 0.641 |
| $\mu_g$: gas viscosity | Pa · s | 0.00000627 |
| ε: void fraction of packed bed | — | 0.29 |
| $d_W$: average size of coke | m | 0.023 |

It is to be noted that the "bosh gas volume" in Table 3 is a calculated value of a total gas volume generated in front of the tuyere due to, e.g., combustion of coke in front of the tuyere due to blasts of: air blown from the tuyere, oxygen for oxygen enrichment, blasted moisture content, and the like; and combustion of supplemental fuel such as pulverized coal, and is indicated by $Nm^3$/min. A calculation method of this bosh gas volume is, for example, described in Iron and Steel, Vol. 48 (1962), No. 12, page 1,606.

As shown in FIG. 10H, when the injection rate of the pulverized iron ore is increased, the viscosity of the bird's nest slag 4 decreases, and the pressure loss reduction amount increases (the pressure loss reduces). However, if the injection rate of the pulverized iron ore is set to greater than or equal to 20 kg/tp, due to an effect of the slag amount in the bird's nest region increasing and the temperature of the bird's nest slag 4 decreasing, the pressure loss reduction amount decreases (the pressure loss increases). If the injection rate of the pulverized iron ore is increased to greater than 50 kg/tp, the pressure loss increases in excess of that when the injection rate of the pulverized iron ore is 0 kg/tp, whereby the effect of injecting the pulverized iron ore is lost.

Incidentally, in order to derive the viscosity of the bird's nest slag 4 from the temperature of the bird's nest 3, described above, it is preferable to conduct a preliminary experiment to grasp how a mixture ratio of the molten iron ore (flux), the slag temperature, and/or the like affect the viscosity of the slag.

Figure 11:
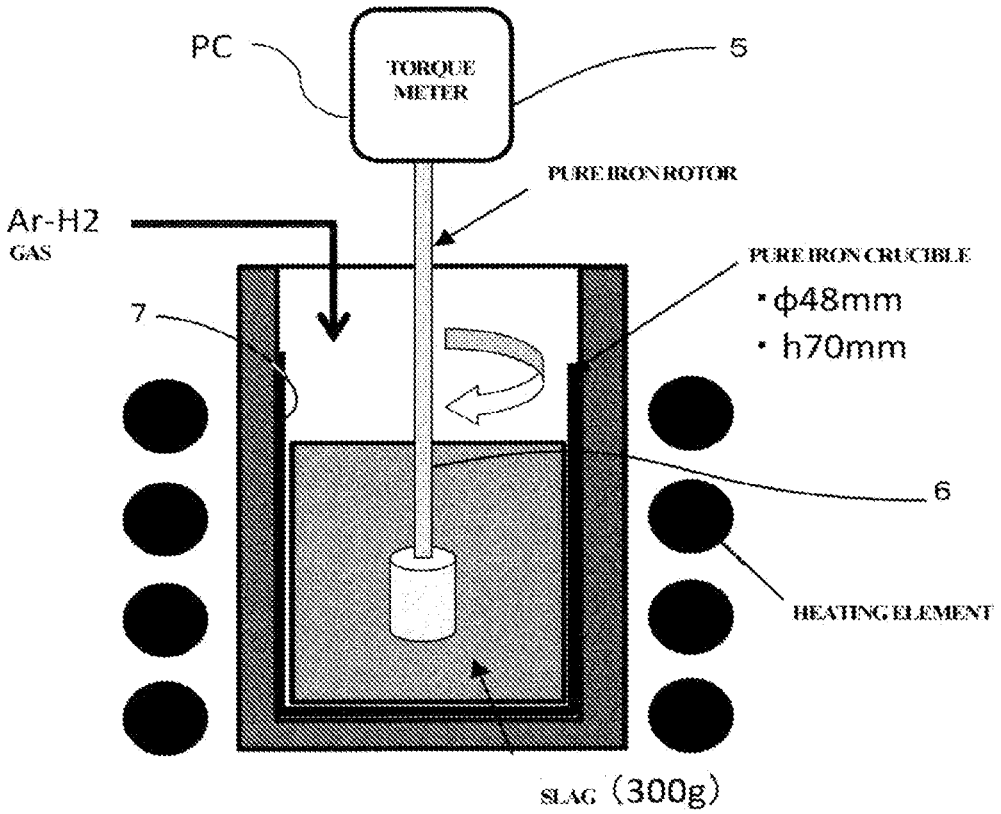
FIG. 11 is a drawing showing a rotating torque meter used in measuring viscosity of slag.

With regard to the preliminary experiment described above, as preliminary preparation, a rotating torque meter 5 such as that shown in FIG. 11 is prepared, and a ceramic paste for antioxidation is applied on a pure iron crucible 7 and a pure iron rotor 6 of the rotating torque meter 5. Further, the pure iron rotor 6 of the rotating torque meter 5 is corrected using JS1000 correction fluid, and a relationship between the rotation speed and the torque is determined. When such correction is conducted, a primary regression equation in which y=ax+b is obtained, enabling determination of a rotor coefficient (K0). It is to be noted that the determination can be conducted as follows:

rotor coefficient: $K0$=[standard viscosity (mPa·s)]/[regression coefficient $b$].

When the rotor coefficient is thus obtained, a reagent (a slag containing flux) mixed in a predetermined formulation (a formulation shown in the following Table 4) is charged into the pure iron crucible 7. The reagent-containing pure iron crucible 7 is then heated to a predetermined temperature using an electronic furnace to melt the reagent. A temperature for the heating is 1,300° C., 1,350° C., 1,400° C., 1,450° C., and 1,500° C. The rotor (the pure iron rotor 6) attached to the rotating torque meter 5 is inserted into a center of the molten slag, and rotation of the rotor is commenced. When a change in measured torque becomes 0.1%/min, it is considered that the viscosity has stabilized, measurement is continued for 1 minute after the viscosity has stabilized, and the values measured in the 1-minute interval are considered to be torque measurement values. Following the measurement, the rotation is stopped, and the experiment is terminated. It is to be noted that the cases in which the viscosity did not stabilize were excluded from the data.

The 1-minute measurement values in which the torque was stabilized, as described above, are adopted as torque measurement values (torque (%)). The obtained torque (%) is substituted into the following equation:

viscosity η (mPa·s)=torque (%)×K0÷rotation speed (rpm), and the slug viscosities η (mPa·s) for which the flux rates differ are determined. The thus determined slug viscosities η (mPa·s) are shown in Table 4.

TABLE 4

| — | Flux rate kg/tp | $SiO_2$ % | CaO % | $Al_2O_3$ % | MgO % | $Fe_3O_4$ % | Total % | C/S — |
|---|---|---|---|---|---|---|---|---|
| 1 | 5.0 | 46.9 | 28.1 | 15.0 | 5.0 | 5.0 | 100 | 0.60 |
| 2 | 10.0 | 43.7 | 26.3 | 15.0 | 5.0 | 10.0 | 100 | 0.60 |
| 3 | 20.0 | 37.5 | 22.5 | 15.0 | 5.0 | 20.0 | 100 | 0.60 |
| 4 | 30.0 | 31.2 | 18.8 | 15.0 | 5.0 | 30.0 | 100 | 0.60 |
| 5 | 5.0 | 37.5 | 37.5 | 15.0 | 5.0 | 5.0 | 100 | 1.00 |
| 6 | 10.0 | 35.0 | 35.0 | 15.0 | 5.0 | 10.0 | 100 | 1.00 |
| 7 | 20.0 | 30.0 | 30.0 | 15.0 | 5.0 | 20.0 | 100 | 1.00 |
| 8 | 30.0 | 25.0 | 25.0 | 15.0 | 5.0 | 30.0 | 100 | 1.00 |

Figure 12:
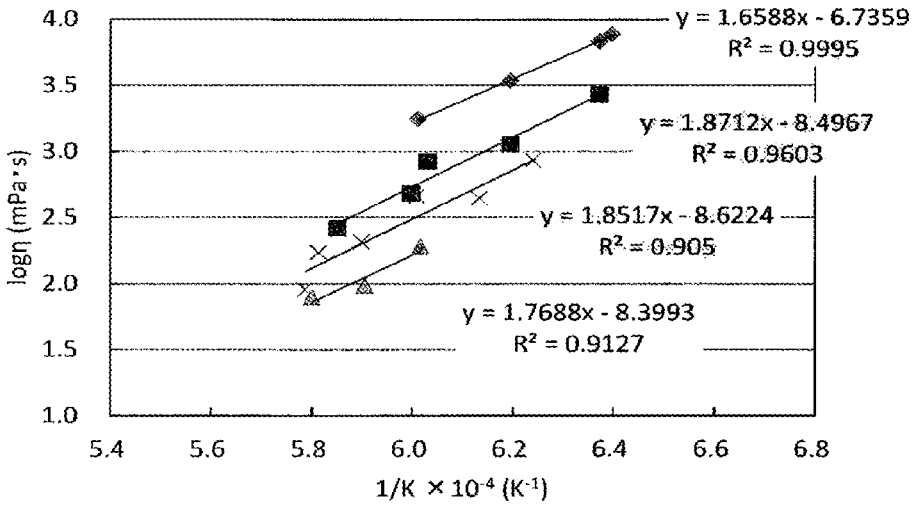
FIG. 12 is a graph showing temperature dependency of viscosity in slag having a basicity of 0.6.
Figure 13:
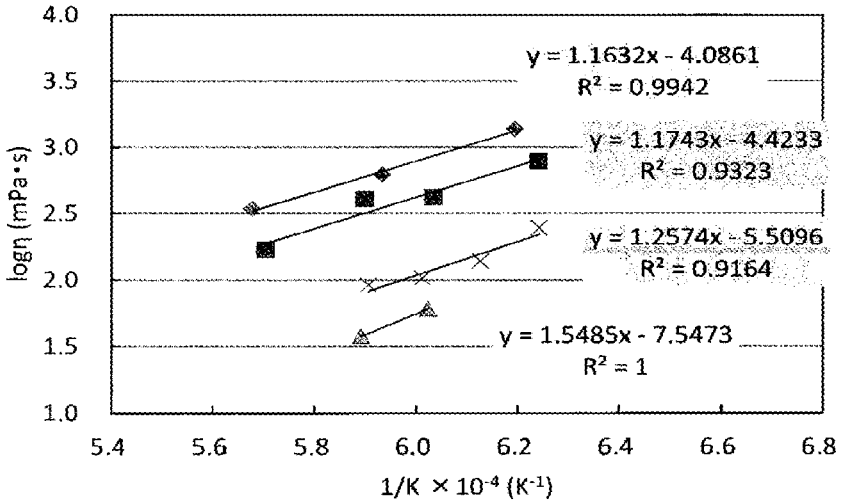
FIG. 13 is a graph showing temperature dependency of viscosity in slag having a basicity of 1.0.

The change in the viscosity of the bird's nest slag 4 (μ) with respect to the injection rate of the pulverized iron ore was thus determined in the case in which the slag basicity C/S was 0.6 and the case in which the basicity C/S was 1.0, in a temperature-dependent manner. Taken together, the obtained results of the temperature dependence of each of the thus obtained slag viscosities (μ) are as shown in FIGS. 12 and 13.

Figure 14:
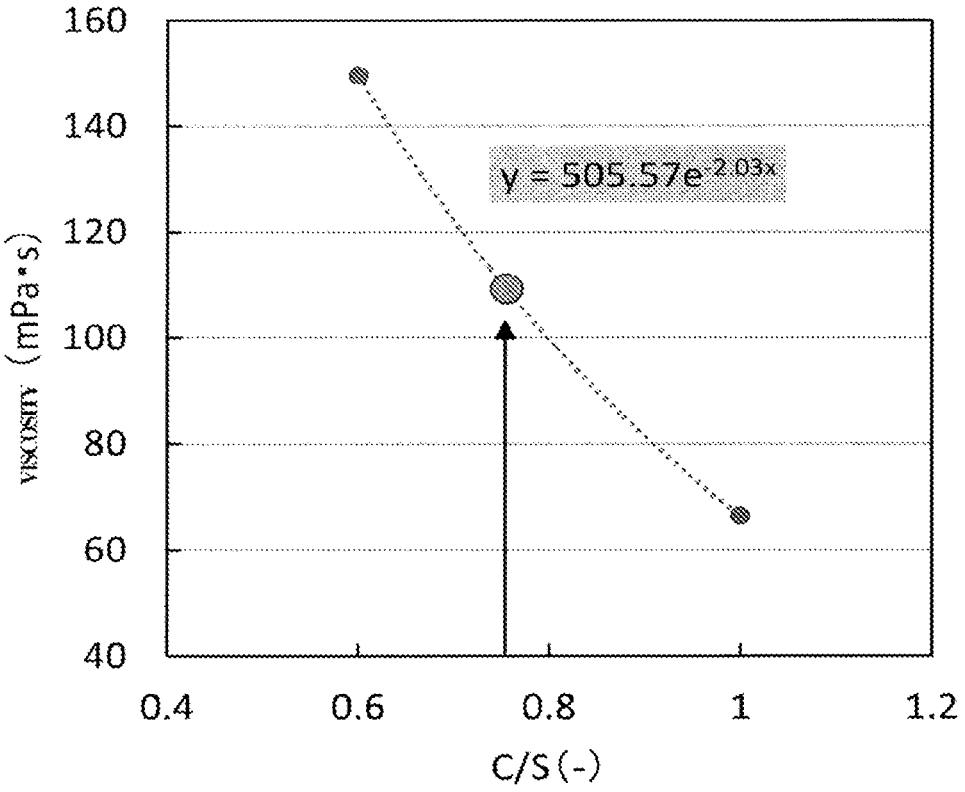
FIG. 14 is a graph showing a relationship between the basicity and viscosity of slag in a case in which a flux rate is 20 kg/tp.
Figure 15:
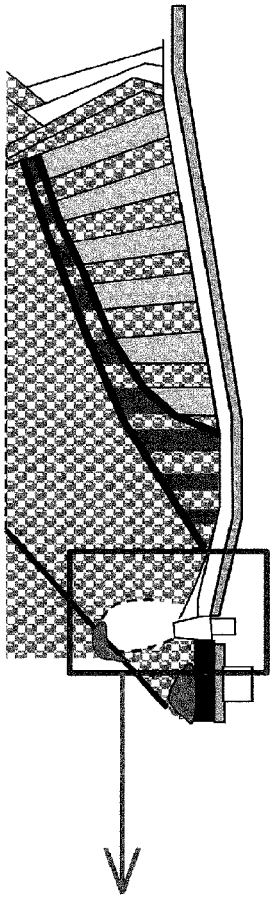
FIG. 15 is a drawing schematically illustrating treatment conducted by a tuyere in a conventional method for operation of a blast furnace.
Figure 15:
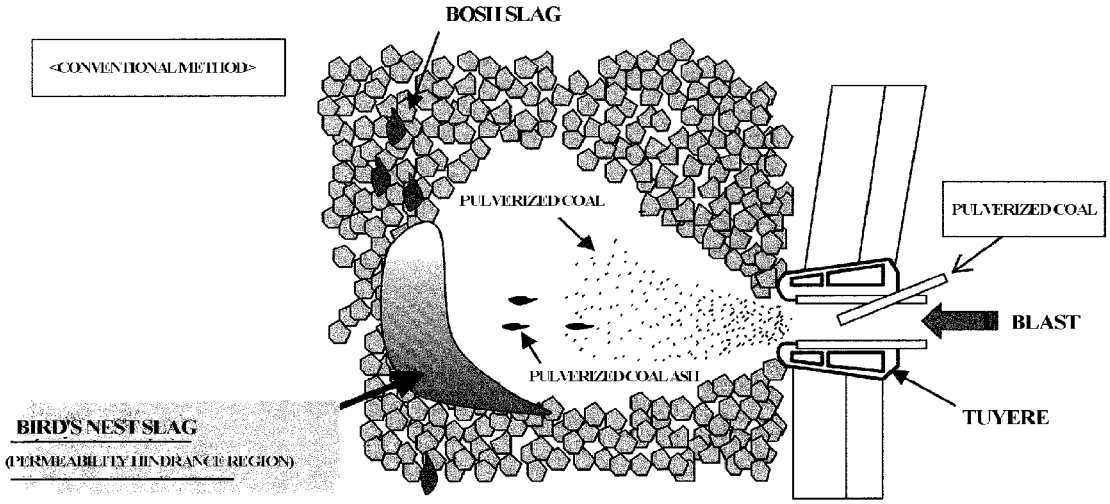

Each viscosity was determined from the relational expression in FIG. 10D, and a relationship between the basicity and the viscosity of the slag was determined as an exponential function. As one example, the relationship between the basicity and the viscosity of the slag organized based on a case in which the flux rate was 20 kg/tp is shown in FIG. 14. From the relational expression of FIG. 14, determination of the viscosity at the basicity of 0.75 is enabled.

In accordance with the above-described viscosity calculation method, when the relationship between the injection rate and the viscosity of the pulverized iron ore is organized, the relationship shown in FIG. 10E is obtained.

According to the relationship shown in FIG. 10E derived from the above-described procedure, or in other words, the relationship shown in FIG. 6, the pressure loss reduces in comparison to that before the injection (the pressure loss reduction amount increases, or the pressure loss change amount is negative) when the injection rate of the pulverized iron ore is greater than or equal to 0 kg/tp and less than or equal to 50 kg/tp; thus, the upper limit of the injection rate of the pulverized iron ore can be defined.

It is to be noted that details of the above-described calculation procedure can be summarized as in Table 5.

TABLE 5

| Item | Content | Notes |
|---|---|---|
| (A) Calculation method of melting ratio of pulverized iron ore | According to this model, the reduction percentage, melting percentage, and raceway border temperature (bird's nest temperature) at the raceway border (bird's nest region) were calculated (FIG. 10A).<br>Molten iron ore contributes to a decrease in the viscosity of the bird's nest as a flux material.<br>Unmelted iron ore does not contribute to the decrease in the viscosity of the slag (FIG. 10B). | Iron and Steel, Xiao et al., Vol. 78, 1992, page 1,230 |
| (B) Calculation method of viscosity of slag | Slag components are calculated from the melting percentage calculated based on the mathematical raceway model.<br>The components are a load average of the bird's nest slag and the molten iron ore (flax). It is to be noted that with regard to components of the bird's nest slag, based on a sampling investigation, it was calculated that a ratio of bosh slag components to slag components in the pulverized coal had accumulated in a ratio of 0.17:1.00. Based on this, it was considered that the bird's nest slag amount was 64 kg/tp.<br>With regard to the slag temperature, a temperature in which the heat absorption due to the direct reducing reaction with the coke, occurring due to injecting the iron ore, was subtracted from the temperature of the raceway border (bird's nest region) determined by the mathematical raceway model was considered to be the slag temperature (FIG. 10D). The experiment was organized by an Arrhenius equation, and the viscosity of the slag was calculated from a temperature in which the heat absorption of the slag of the arbitrary components was considered (FIG. 10E). | FIGS. 11 to 14 |
| (C) Calculation method of linear velocity of dripping | Used in FIG. 10F.<br>$u = 25 \times \mu^{-1}$ (1) | Materials and Processes, Kato et al., Vol. 28, 2015, S25 |
| (D) Calculation method of hold-up amount | Used in FIG. 10G.<br>$h = \frac{1}{s} \times \frac{W}{u}$ (2) | Materials and Processes, Kato et al., Vol. 28, 2015, S25 |
| (E) Calculation method of pressure loss | Used in FIG. 10H.<br>$\frac{\Delta P}{L} = \left\{k_1\left[\frac{1-[\varepsilon-h]}{d_w}\right]\mu_g v + k_2\left[\frac{1-[\varepsilon-h]}{d_w}\right]\rho_g v^2\right\} \Big/ (\varepsilon-h)^3$ (3) | Iron and Steel, Fukutake et al., Vol. 66, 1980, page 1,974 |

On the other hand, the lower limit of the injection rate of the pulverized iron ore can be derived from an experiment using an actual blast furnace (actual apparatus test).

The blast furnace 1 used in the actual apparatus test was an actual furnace of 2,112 $m^3$, having productivity of 1.8 $t/m^3$/day. The test operation was conducted over a span of five days while changing the iron ore amount of the pulverized iron ore injected into the blast furnace 1 in the following order: 0.0 kg/tp to 1.3 kg/tp to 2.5 kg/tp to 5.0 kg/tp.

It is to be noted that the pulverized iron ore injected into the actual furnace has a composition as shown in Table 6.

TABLE 6

| — | T.Fe % by mass | $SiO_2$ % by mass | CaO % by mass | LOI % by mass | HGI — |
|---|---|---|---|---|---|
| Pulverized iron ore | 58.5 | 5.0 | 0.03 | 11.1 | 42.9 |

It is to be noted that the above-described pulverized iron ore was pulverized by conducting treatment such as that shown in FIG. 8.

The results of the actual apparatus test are shown in Table 7 below.

of the pulverized coal rate and the coke rate) is 524 kg/tp for both the Examples and the Comparative Examples.

Operations were conducted while carrying out injection of the pulverized iron ore under such conditions for the pulverized coal rate, the loss on ignition, and the reducing agent rate, and measurement was carried out regarding the manner in which the pressure loss changed with respect to that before the injection. The measurement results are shown in Table 7.

As shown in Table 7, the injection rates of the pulverized iron ore in the Examples are 2.5 kg/tp and 5.0 kg/tp, and the injection rates of the pulverized coal in the Comparative Examples were 0.0 kg/tp and 1.3 kg/tp.

Concerning the above-described Examples and Comparative Examples, with regard to the Examples, the pressure loss change amounts were −1.72 kPa and −3.33 kPa; thus, it can be understood that the pressure loss was lower compared to that before the injection, and the gas permeability was favorable. In contrast, with regard to the Comparative Examples, the pressure loss change amounts were 0.00 kPa and 0.73 kPa; thus, the pressure loss was the same as that before the injection, or was greater than that before the injection, and the gas permeability was not improved.

From the above, it can be inferred that the effect of improving the gas permeability can be obtained in the case

TABLE 7

| | Preamble | | Constituent features, execution conditions | | | | | | | | | |
|---|---|---|---|---|---|---|---|---|---|---|---|---|
| | A1 pulverized coal rate | | B1 LOI | | C1 injection rate of | | Reducing agent | | | | | |
| Experiment No. | (PC rate) range in claim: greater than or equal to 150 kg/tp (kg/tp) | suitability | range in claim: 9.0 to 12.0% by mass (% by mass) | suitability | pulverized iron ore range in claim: 2.5 to 50.0 kg/tp (kg/tp) | suitability | PC rate (kg/tp) | coke rate (CR) (kg/tp) | reducing agent rate (RAR) (kg/tp) | pressure loss amount (kPa) | Evaluation | Explanation |
| [Examples] | | | | | | | | | | | | |
| 1 | 208 | good | 11.1 | good | 2.5 | M | 208 | 316 | 524 | −1.72 | good | Lower portion permeability resistance decreased in excess of base. |
| 2 | 208 | good | 11.1 | good | 5.0 | M | 208 | 316 | 524 | −3.33 | good | Lower portion permeability resistance decreased in excess of base. |
| [Comparative Examples] | | | | | | | | | | | | |
| 3 | 208 | good | — | — | 0.0 | L | 208 | 316 | 524 | 0.00 | — | Base |
| 4 | 208 | good | 11.1 | good | 1.3 | L | 208 | 316 | 524 | 0.73 | bad | Pressure loss increased due to disruption in circumferential balance. |

RAR = PC + CR

"good" was chosen for items in which the pressure loss was lower than the base.

Looking at Table 7, the pulverized coal rate (the injection rate of the pulverized coal) in both of the Examples and the Comparative Examples is 208 kg/tp (satisfying the condition of greater than or equal to 150 kg/tp), and the loss on ignition (LOI) of the coal, being the raw material of the pulverized coal, is 11.1% by mass (satisfying the condition of 9.0% to 12.0% by mass). Furthermore, the reducing agent rate (sum in which the injection rate of the pulverized iron ore is greater than or equal to 2.5 kg/tp.

Comprehensively inferring from the results of the above-described Examples and Comparative Examples, it is inferred that by pulverizing the coal to make the pulverized coal, and pulverizing the iron ore to make the pulverized iron ore; and injecting the pulverized coal and the pulverized iron ore from the tuyere 2, wherein the loss on ignition of the iron ore is greater than or equal to 9% by mass and less than or equal to 12% by mass, the injection rate of the pulverized coal is greater than or equal to 150 kg/tp, and the injection rate of the pulverized iron ore is greater than or equal to 2.5 kg/tp and less than or equal to 50.0 kg/tp, improving the gas permeability in the lower portion of the blast furnace 1 by injection of the pulverized iron ore from the tuyere 2 is enabled.

It is to be noted that the embodiments disclosed herein should be considered exemplary in all respects and should not be construed as limited. In particular, in the embodiments disclosed herein, items which are not clearly disclosed, e g, running conditions, operating conditions, various parameters, and dimensions, weights, and volumes of structures, do not depart from ranges pertaining to general execution by a person of average skill in the art, and values which can be easily estimated by a person of average skill in the art have been employed.

EXPLANATION OF THE REFERENCE SYMBOLS

1 blast furnace

2 tuyere

3 bird's nest region

4 bird's nest slag

5 rotating torque meter

6 pure iron rotor

7 pure iron crucible

The invention claimed is:

1. A method for operation of a blast furnace, the method comprising:

pulverizing coal to make pulverized coal, and pulverizing iron ore to make pulverized iron ore; and injecting the pulverized coal and the pulverized iron ore together from a tuyere, wherein a loss on ignition of the iron ore is greater than or equal to 9% by mass and less than or equal to 12% by mass, wherein an injection rate of the pulverized coal is greater than or equal to 150 kg/tp, wherein an injection rate of the pulverized iron ore is greater than or equal to 2.5 kg/tp and less than or equal to 50.0 kg/tp, wherein the pulverized coal and the pulverized iron ore, each have a maximum grain size of less than or equal to 1,000 μm, wherein a Hardgrove Index of the coal to be pulverized is greater than or equal to 40 and less than or equal to 90, wherein the pulverized coal comprises ash comprising 50% by mass or more and 60% by mass or less $SiO_2$, and 20% by mass or more and 30% by mass or less $Al_2O_3$, wherein a grain size of each of the pulverized coal is equivalent to a grain size of the pulverized iron ore, and wherein a pressure loss of the blast furnace reduces in comparison to a pressure loss before the injection of the pulverized iron at said injection rate; and a pressure loss change amount of the blast furnace becomes negative.

2. The method according to claim 1, characterized in that the iron ore and the coal are pulverized together.

* * * * *